US010113392B2

(12) United States Patent
Vick, Jr. et al.

(10) Patent No.: US 10,113,392 B2
(45) Date of Patent: Oct. 30, 2018

(54) TUBING PRESSURE INSENSITIVE SURFACE CONTROLLED SUBSURFACE SAFETY VALVE

(71) Applicant: Halliburton Energy Services, Inc., Houston, TX (US)

(72) Inventors: James Dan Vick, Jr., Dallas, TX (US); Jimmie Robert Williamson, Jr., Carrollton, TX (US); Jeremy Pike Brimer, Wylie, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 104 days.

(21) Appl. No.: 14/387,694

(22) PCT Filed: May 21, 2013

(86) PCT No.: PCT/US2013/042040

§ 371 (c)(1),
(2) Date: Sep. 24, 2014

(87) PCT Pub. No.: WO2014/189494

PCT Pub. Date: Nov. 27, 2014

(65) Prior Publication Data

US 2016/0138365 A1 May 19, 2016

(51) Int. Cl.

| | |
|---|---|
| ***E21B 34/10*** | (2006.01) |
| ***E21B 34/14*** | (2006.01) |
| *E21B 34/00* | (2006.01) |

(52) U.S. Cl.
CPC ..... *E21B 34/10* (2013.01); *E21B 34/14* (2013.01); *E21B 2034/005* (2013.01)

(58) Field of Classification Search
CPC ..... E21B 34/10; E21B 34/14; E21B 2034/005
(Continued)

(56) References Cited

U.S. PATENT DOCUMENTS

| | | | |
|---|---|---|---|
| 7,896,082 | B2 | 3/2011 | Lake et al. |
| 2008/0066921 | A1 | 3/2008 | Bane et al. |

(Continued)

OTHER PUBLICATIONS

International Search Report and Written Opinion issued in related International Application No. PCT/US2013/042040 dated Feb. 17, 2014, 14 pages.

*Primary Examiner* — Matthew R Buck
*Assistant Examiner* — Patrick F Lambe
(74) *Attorney, Agent, or Firm* — Scott Richardson; Baker Botts L.L.P.

(57) ABSTRACT

Method and systems for opening and closing a subsurface valve are disclosed. A rod piston forms a first piston chamber, a second piston chamber and a third piston chamber within a housing. The first piston chamber is fluidically coupled to a high tubing pressure and the second piston chamber is fluidically coupled to a surface control line and a first compartment of a storage chamber. The third piston chamber is coupled to a second compartment of the storage chamber. A flow tube couples the rod piston to a flapper. The rod piston is moved between a first position and a second position in response to a change in a pressure in at least one of the first piston chamber, the second piston chamber and the third piston chamber. The movement of the rod piston between the first position and the second position at least one of opens and closes the flapper.

20 Claims, 5 Drawing Sheets

(58) Field of Classification Search
USPC ..... 166/375
See application file for complete search history.

(56) References Cited

U.S. PATENT DOCUMENTS

| | | | | |
|---|---|---|---|---|
| 2008/0128137 | A1 | 6/2008 | Anderson et al. | |
| 2009/0188662 | A1 | 7/2009 | Casciaro et al. | |
| 2011/0100645 | A1* | 5/2011 | Yapici | E21B 23/04 166/375 |
| 2011/0155381 | A1* | 6/2011 | Reaux | E21B 34/066 166/334.1 |
| 2012/0234607 | A1* | 9/2012 | Kinsella | E21B 21/10 175/403 |

* cited by examiner

TUBING PRESSURE INSENSITIVE SURFACE CONTROLLED SUBSURFACE SAFETY VALVE

CROSS-REFERENCE TO RELATED APPLICATION

This application is a U.S. National Stage Application of International Application No. PCT/US2013/042040 filed May 21, 2013, which is hereby incorporated by reference in its entirety.

BACKGROUND

The present invention relates to subterranean operations and, more particularly, to a method and system for opening and closing a subsurface valve used in conjunction with such operations.

Hydrocarbons, such as oil and gas, are commonly obtained from subterranean formations that may be located onshore or offshore. The development of subterranean operations and the processes involved in removing hydrocarbons from a subterranean formation are complex. Typically, subterranean operations involve a number of different steps such as, for example, drilling a wellbore at a desired well site, treating the wellbore to optimize production of hydrocarbons, and performing the necessary steps to produce and process the hydrocarbons from the subterranean formation.

When performing subterranean operations, it may be desirable to close off a well in the event of an uncontrolled condition that may damage property, injure personnel or cause pollution. One of the mechanisms used to close off a well is a Surface Controlled Subsurface Safety Valve ("SCSSV"). A SCSSV typically includes a flapper. The flapper is a closure member that may be pivotally mounted such that it is rotatable between a first "open" position and a second "closed" position. When in the closed position, the flapper may substantially close off the well. In certain implementations, a flow tube may be actuated downwardly against the flapper to rotate it into the open position. The flow tube may be actuated using a hydraulic control system. A closure spring may be mounted to the flapper's pivot rod. The closure spring may be biased so as to move the flapper back to its closed position once the actuation pressure applied to the flow tube is reduced below a pre-set amount.

The hydraulic control system used to actuate the flow tube may use a number of seals. A degradation of these seals may lead to a failure of the SCSSV, exposing the system to tubing pressure. It is therefore desirable to develop a hydraulic control system which retains the ability to close the flapper even if one or more of the SCSSV seals have been degraded.

While embodiments of this disclosure have been depicted and described and are defined by reference to examples set forth in the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The terms "couple" or "couples," as used herein are intended to mean either an indirect or a direct connection. Thus, if a first device couples to a second device, that connection may be through a direct connection, or through an indirect mechanical connection via other devices and connections. Similarly, a first component is "fluidically coupled" to a second component if there is a path for fluid flow between the two components. The terms "up" or "uphole" as used herein means along the drillstring or the hole from the distal end towards the surface, and "down" or "downhole" as used herein means along the drillstring or the hole from the surface towards the distal end. Further, the terms "up," "uphole," "down" and "downhole" are merely used to denote the relative location of different components and are not meant to limit the present disclosure to only a vertical well. Specifically, the present disclosure is applicable to horizontal, vertical, deviated or any other type of well.

It will be understood that the term "well" is not intended to limit the use of the equipment and processes described herein to developing an oil well. The term also encompasses developing natural gas wells or hydrocarbon wells in general. Further, such wells can be used for production, monitoring, or injection in relation to the recovery of hydrocarbons or other materials from the subsurface.

Figure 1A:
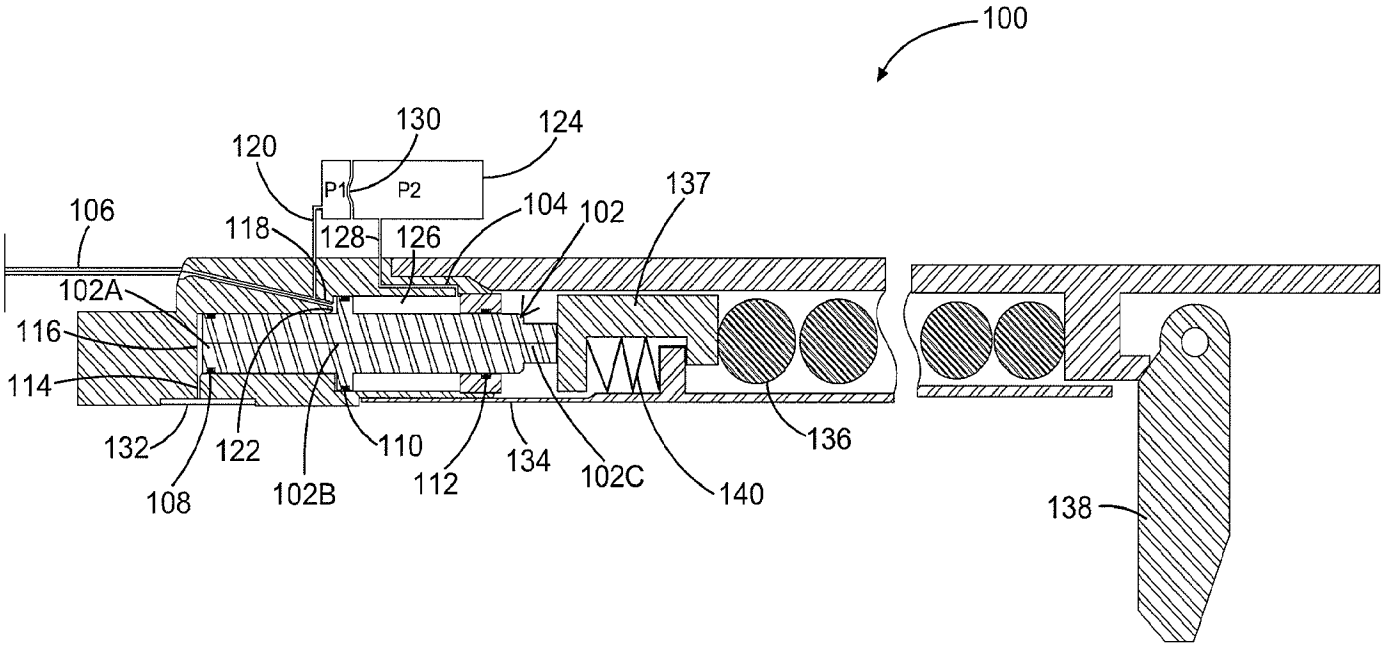
FIG. 1A shows a schematic of a cross-sectional view of a SCSSV in accordance with one illustrative embodiment of the present disclosure.

Turning now to FIG. 1A, a cross-sectional view of a SCSSV in accordance with an illustrative embodiment of the present disclosure is denoted generally with reference numeral 100. The SCSSV 100 includes a hydraulic operating piston that includes a rod piston 102 disposed within a housing 104. For illustrative purposes, the rod piston 102 of FIG. 1A may have a first distal end 102A, a middle portion 102B and a second distal end 102C. The term "middle portion" as used herein refers to any portion of the rod piston 102 that lies between its two distal ends.

A single control line 106 may deliver pressure to the rod piston 102 from the surface or from any other location. The illustrative embodiment of FIG. 1A depicts only one of the hydraulic operating pistons of a SCSSV 100. However, as would be appreciated by those of ordinary skill in the art having the benefit of the present disclosure, additional hydraulic operating pistons may be added to the SCSSV 100 by routing the single control line 106 pressure through one or more external control lines. For instance, when using a SCSSV having a smaller outer diameter ("OD"), two or more pistons may be used to minimize the OD of the entire assembly.

As shown in FIG. 1A, the rod piston 102 may have a first sealing diameter (D1) at a middle portion 102B thereof and a second sealing diameter (D2 ) at its two distal ends 102A, 102C. In the illustrative embodiment of FIG. 1A, the first sealing diameter D1 at the middle portion 102B of the rod piston 102 is larger than the second sealing diameter D2 at its distal ends 102A, 102C. However, in certain embodiments, the first sealing diameter D1 may be smaller than the second sealing diameter D2 without departing from the scope of the present disclosure.

A first seal 108, a second seal 110, and a third seal 112 may be used to seal the rod piston 102 in the housing 104. Specifically, the seals 108, 110, 112 may seal the first distal end 102A, the middle portion 102B and the second distal end 102C of the rod piston 102, respectively. As would be appreciated by those of ordinary skill in the art with the benefit of this disclosure, in certain illustrative embodiments, each of the seals 108, 110, 112 may in fact be comprised of a seal stack having two or more different sealing components. Further, although all three seals 108, 110, 112 are depicted as O-ring seals for simplicity, other seals may be used without departing from the scope of the present disclosure.

In certain implementations, the seals 108, 110, 112 may be non-elastomeric seal stacks. Additionally, the seals 108, 110, 112 may have metal-to-metal sealing up and down stops. The structure and operation of such up and down stops is well known to those of ordinary skill in the art and will therefore not be discussed in detail herein. Specifically, the up stop is a metal protrusion that creates a metal-to-metal seal on the conical drill angle of the piston hole only when the SCSSV is in the closed position. This metal to metal seal is used to add an additional sealing element to the seal stack for added insurance against control fluid leakage. In contrast, the metal-to-metal sealing down stop makes contact and seals only when the SCSSV is in the open position. In certain applications, there is likely to be a significant differential pressure across the seals 108, 110, 112. As a result, it is important that the seals 108, 110, 112 provide a more effective seal than what may be necessary in applications that involve a lower pressure differential. In certain implementations, the seals 108, 110, 112 may be comprised of metal-to-metal seals with elastomeric secondary seals.

The sealing diameter D2 at the distal ends 102A, 102C of the rod piston 102 may be used to pressure balance the rod piston 102 to the tubing pressure. Specifically, tubing pressure is applied to the first distal end 102A of the rod piston 102 through the high tubing pressure branch 114. The high tubing pressure branch 114 directs this pressure to a first piston chamber 116. The first piston chamber 116 is a chamber that is formed in the housing 104 between the first seal 108 on the first distal end 102A of the rod piston 102 and a wall of the housing 104. The dynamic sealing surfaces of the two distal ends 102A, 102C of the rod piston 102 are designed to be of substantially equal diameters so that the rod piston 102 is pressure balanced to the tubing pressure. In deeper well or wells having higher pressures, balancing the tubing pressure may be of particular importance as the required hold down pressure may be dramatically lower than that of conventional wells.

In the illustrative embodiment of FIG. 1A, a hydraulic control pressure delivered by the single control line 106 is denoted as P1. The term "hydraulic control pressure" as used herein refers to a pressure amount that is selected and delivered by a user/operator from the surface or subsurface well head. The single control line 106 may be directed into a second piston chamber branch 118 and a first storage chamber branch 120. The second piston chamber branch 118 directs the hydraulic control pressure (P1) to a second piston chamber 122 formed in the housing 104 between the first seal 108 and the second seal 110 on a first side of the middle portion 102B of the rod piston 102. The pressure in the second piston chamber 122 and the third piston chamber 126 are referred to herein as (P1) and (P2) respectively. The first storage chamber branch 120 directs the hydraulic control pressure (P1) to a first compartment of a storage chamber 124. Accordingly, the first storage chamber branch 120 fluidically couples the first compartment of the storage chamber 124 and the second piston chamber 122 so that they are maintained at substantially the same pressure.

A second compartment of the storage chamber 124 is pressurized to a second pressure (P2). This second pressure (P2) is directed to a third piston chamber 126 through a second storage chamber branch 128. Accordingly, the second storage chamber branch 128 fluidically couples the second compartment of the storage chamber 124 and the third piston chamber 126 so that they are maintained at the same pressure. The third piston chamber 126 is formed in the housing 104 between the second seal 110 and the third seal 112 on a second side of the middle portion 102B of the rod piston 102, downhole from the second piston chamber 122. As shown in FIG. 1A, the volume of the first piston chamber 116 and the volume of the third piston chamber 126 vary inversely to one another as the rod piston 102 is moved from one position to another in the housing 104. A rupture disc 130 separates the first compartment and the second compartment of the storage chamber 124.

A compressible fluid may be used to maintain the second pressure (P2) in the second compartment of the storage chamber 124 and the pressure of the third piston chamber 126 at a desired value. In certain implementations, the compressible fluid may be vacuum or low pressure air which may be almost at atmospheric pressure. The volume of the storage chamber 124 is designed such that movement of the rod piston 102 does not significantly increase the pressure (P2) in the second compartment of the storage chamber 124. In accordance with certain illustrative embodiments (not shown), the second compartment of the storage chamber 124 may be contained in a control line that may extend to the surface, almost to the surface, or to the well head. In such embodiments, the control line may be filled with a light compressible fluid or a gas.

Additionally, one or more filters 132 may be used to prevent dirty tubing fluid from affecting the life of the seal 108 or filling the first piston chamber 116 with debris or other unwanted materials. Moreover, in certain implementations, a wiper seal (not shown) may be used to prevent dirty tubing fluid from reaching the seals 122. A flow tube 134 is coupled to the second distal end 1020 of the rod piston 102. In certain implementations, the flow tube 134 may be coupled to the rod piston 102 through a connection piece 137.

Accordingly, in operation, as pressure (P1) is applied to the rod piston 102 from the single control line 106 the rod piston 102 is moved downhole (to the right in FIG. 1 A) and applies a downward pressure to the flow tube 134. The application of this downward pressure moves the flow tube 134 downward and compresses a closure spring 136. The downward movement of the flow tube 134 also exerts pressure on the flapper 138 and moves the flapper 138 into the open position. Accordingly, the movement of the rod piston 102 between a first position and a second position may be used to open and close the flapper 138 using the flow tube 134 which couples the rod piston 102 to the flapper 138. However, the closure spring 136 is biased to return the flapper 138 to its closed position once the pressure (P1) is reduced below a certain threshold value. Further, in certain implementations, another spring 140 may be provided at an interface of the flow tube 134 and the rod piston 102. The spring 140 may be used to transmit the force from the rod piston 102 to the flow tube 134. Accordingly, the movement of the rod piston 102 between a first position and a second position in response to changes in pressure of the three piston chambers 116, 122, 126 moves the flow tube 134 which in turn, opens and closes the flapper 138.

When the flapper 138 is in the closed position, it may rest against a seat that surrounds a passage (not shown) in a valve housing (not shown). As would be appreciated by those of ordinary skill in the art, with the benefit of the present disclosure, that passage may be isolated from pressure in the single control line 106 but it may be exposed to internal tubing pressure.

Figure 1B:
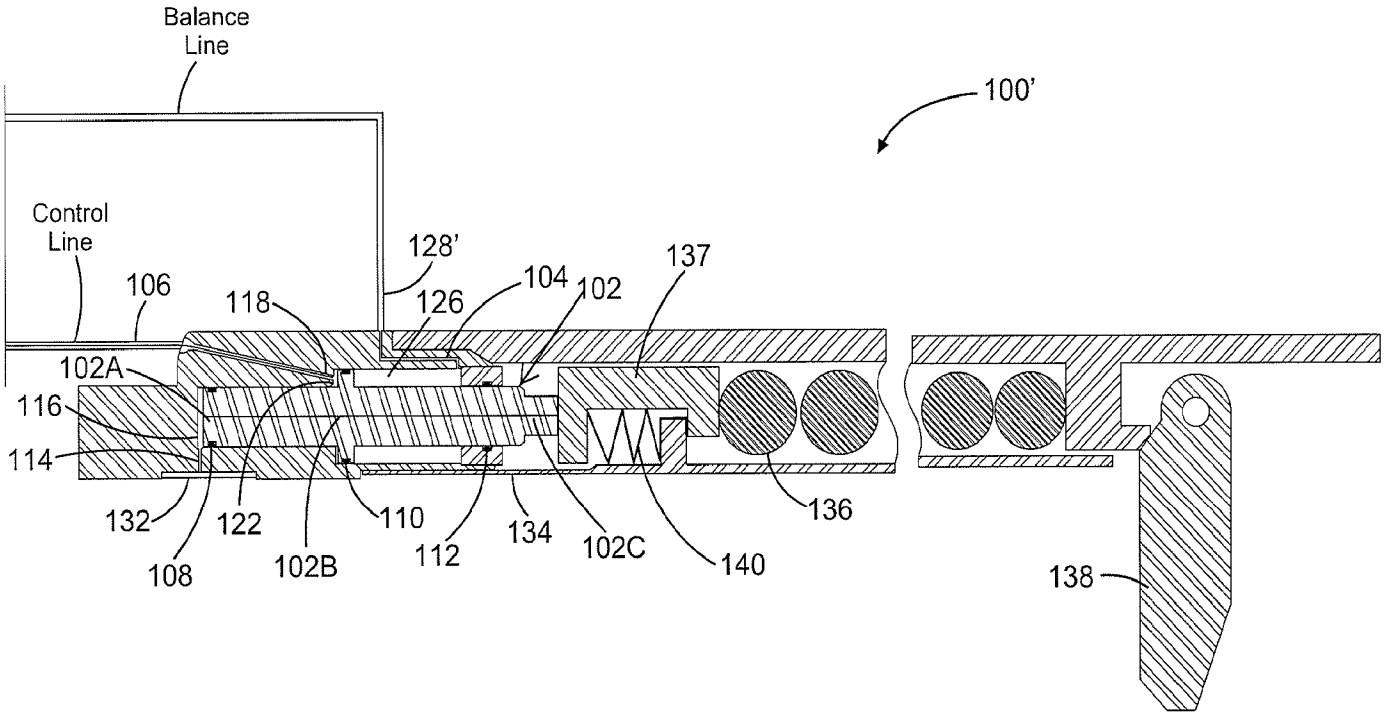
FIG. 1B shows a schematic of a cross-sectional view of a SCSSV in accordance with another illustrative embodiment of the present disclosure.

Turning now to FIG. 1B a cross-sectional view of a SCSSV in accordance with an illustrative embodiment of the present disclosure is denoted generally with reference numeral 100'. In this embodiment, the storage chamber 124 and the first storage chamber branch 120 are eliminated and the second storage chamber branch 128 runs to the surface and becomes a balanced line having pressure P2. Accordingly, the second storage chamber branch 128 of FIG. 1A is replaced by a balanced line 128' in FIG. 1B. Because the storage chamber 124 is removed, any concerns associated with leaks from the storage chamber 124 are eliminated. The remaining portions of the SCSSV 100' remain the same as that of the SCSSV 100 discussed in conjungtion with FIG. 1A above.

In the SCSSV 100', under normal operating conditions, when the pressure (P1) from the single control line 106 drops below a certain threshold value, the pressure from the closure spring 136 overcomes the pressure applied by the rod piston 102 to the flow tube 134 and the flapper 138 is closed by the closure spring 136. The control line 106 and the balanced line 128' both run to the surface and can be regulated therefrom. Accordingly, if the seal 110 fails, the pressure on the first side of the middle portion 102B of the rod piston 102 (i.e., P1) will be the same as the pressure on the second side of the middle portion 102B of the rod piston 102 (i.e., P2) and the pressure applied by the pressure balanced piston is overcome by the compressed closure spring 136, thereby closing the flapper 138.

Similarly, if the seal 108 fails, the pressure in the second piston chamber 122 is lost. As a result, the pressure differential between the third piston chamber 126 and the second chamber 122 along with the pressure from the spring 136 shifts the rod piston 102 and the flow tube 134 uphole and closes the flapper 138 (fail safe mode). Finally, if the seal 112 fails, the single control line 106 continues to supply fluid/pressure to the first piston chamber 122. If the pressure in the particular section of the well bore where the SCSSV 100' is located is higher than the single control line 106 pressure, then the flapper 138 will close. In certain implementations, methods and systems disclosed herein may be implemented in a subsea environment. In such applications, the balance line 128' may be vented to the sea. Accordingly, if the pressure in the particular section of the well bore where the SCSSV 100' is located is higher than the balance line 128' pressure, the vent line will be closed and the rod piston 102 will no longer be balanced. As a result, the flapper 138 goes into the closed position when the single control line 106 pressure is reduced.

Figure 1C:
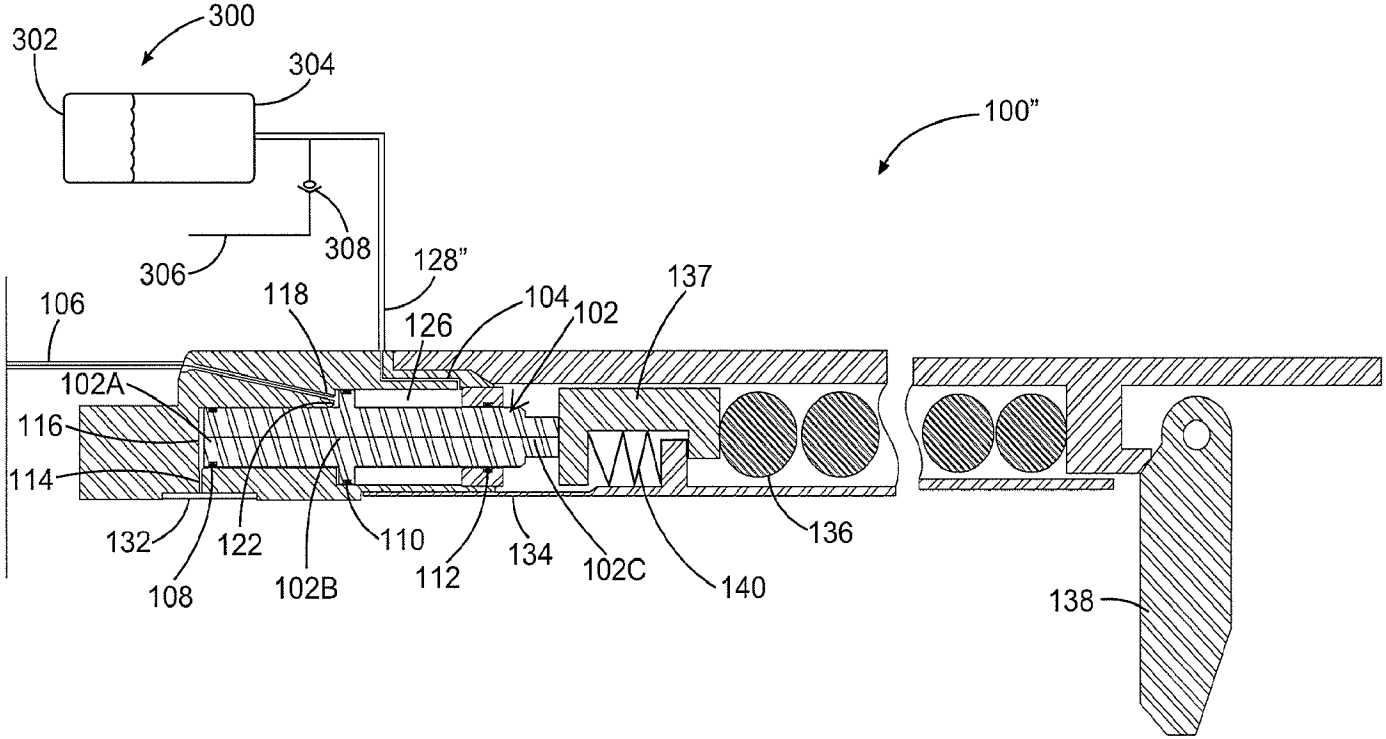
FIG. 1C shows a schematic of a cross-sectional view of a SCSSV in accordance with another illustrative embodiment of the present disclosure.

FIG. 1C depicts a SCSSV in accordance with yet another illustrative embodiment of the present disclosure denoted generally with reference numeral 100". In this embodiment, the storage chamber 124 and the first storage chamber branch 120 of FIG. 1A are eliminated and the second storage chamber branch 128 is directed to a self charging chamber 300. Accordingly, the second storage chamber branch 128 of FIG. 1A is replaced by a self charging chamber line 128" in FIG. 1C. Because the storage chamber 124 is removed, any concerns associated with leaks from the storage chamber 124 are eliminated. The remaining portions of the SCSSV 100' remain the same as that of the SCSSV 100 discussed in conjungtion with FIG. 1A above.

The self charging chamber 300 may contain two internal fluids. The first, is a high pressure gas 302 and the second is a liquid barrier 304. In certain embodiments, the high pressure gas 302 corresponds to the high annulus pressure and the liquid barrier 304 is the annulus fluid. The term "annulus fluid" as used herein refers to fluids that may be flowing through an annulus between the SCSSV 100" and a wellbore wall or a wellbore casing (not shown). Specifically, when the self charging chamber 300 is first directed downhole, it is at ambient pressure. Once downhole, the self charging chamber 300 can be "charged" using the annulus pressure. Specifically, once at a desired location downhole, fluid can flow from the annulus into the self charging chamber 300 through an annulus pressure inlet 306 and a one way check-valve 308.

As annulus fluid flows into the self charging chamber 300, the ambient pressure therein is compressed by the annulus fluid. Annulus fluid will continue to flow into the self charging chamber 300 until the pressure of the gas portion and that of the annulus fluid are the same. Specifically, annulus fluid continues to flow into the self charging chamber 300 until the high pressure gas 302 and the liquid barrier 304 are at the same pressure. In certain embodiments, a check valve 308 is provided to regulate fluid flow into the self charging chamber 300. At this point, the check valve 308 closes and the self charging chamber 300 has been charged. Because a one way check valve 308 is utilized, any reduction in the annulus pressure will not impact the pressure stored in the self charging chamber 300.

In the SCSSV 100", under normal operating conditions, when the pressure (P1) from the single control line 106 drops below a certain threshold value, the pressure from the closure spring 136 overcomes the pressure applied by the rod piston 102 to the flow tube 134 and the flapper 138 is closed by the closure spring 136. If the seal 110 fails, the pressure on the first side of the middle portion 102B of the rod piston 102 (i.e., P1) will be the pressure applied by the single control line 106. In contrast, the pressure applied to the second side of the middle portion 102B of the rod piston is the high annulus pressure applied through the self charging chamber line 128" from the self charging chamber 300. Because the pressure from the self charging chamber line 128" is equal to or higher than the pressure from the single control line 106, the pressure applied by the pressure balanced rod piston 102 along with the pressure supplied by the compressed closure spring 136 closes the flapper 138.

Similarly, if the seal 108 fails, the pressure in the second piston chamber 122 is lost. As a result, the pressure differential between the third piston chamber 126 and the second chamber 122 along with the pressure from the spring 136 closes the flapper 138 (fail safe mode). Finally, if the seal 112 fails, the single control line 106 continues to supply fluid/pressure to the first piston chamber 122. If the pressure in the particular section of the well bore where the SCSSV 100" is located is higher than the single control line 106 pressure, then the flapper 138 will close.

Finally, if the seal 112 fails, the high tubing pressure enters the third piston chamber 126 which is in fluid communication with the self charging chamber 300 through the self charging chamber line 128". At this point, both the second piston chamber 122 and the third piston chamber 126 will be at the high tubing pressure and P1 and P2 become the same. Accordingly, the pressure applied by the pressure balanced piston is overcome by the compressed closure spring 136, thereby closing the flapper 138.

In certain implementations, it may be desirable to clean and/or filter the annulus fluid before it is directed into the self charging chamber 300. In such embodiments, a filter may be used to clean the fluid. Further, in certain embodiments, a clean fluid chamber (not shown) may be placed between the self charging chamber 300 and the self charging chamber line 128". The use of such a clean fluid chamber permits utilization of the annulus pressure in the manner described above in conjunction with FIG. 1C without directing any debris from the annulus fluid into the SCSSV 100". Further, in certain embodiments, the check valve 308 may be replaced with a spring biased check valve to regulate the amount of "charge" delivered to the self charging chamber 300. Specifically, the bias in the spring biased check valve may counter the annulus pressure such that amount of pressure delivered to the self charging chamber 300 corresponds to the difference between the annulus fluid pressure and the spring bias.

Figure 2A:
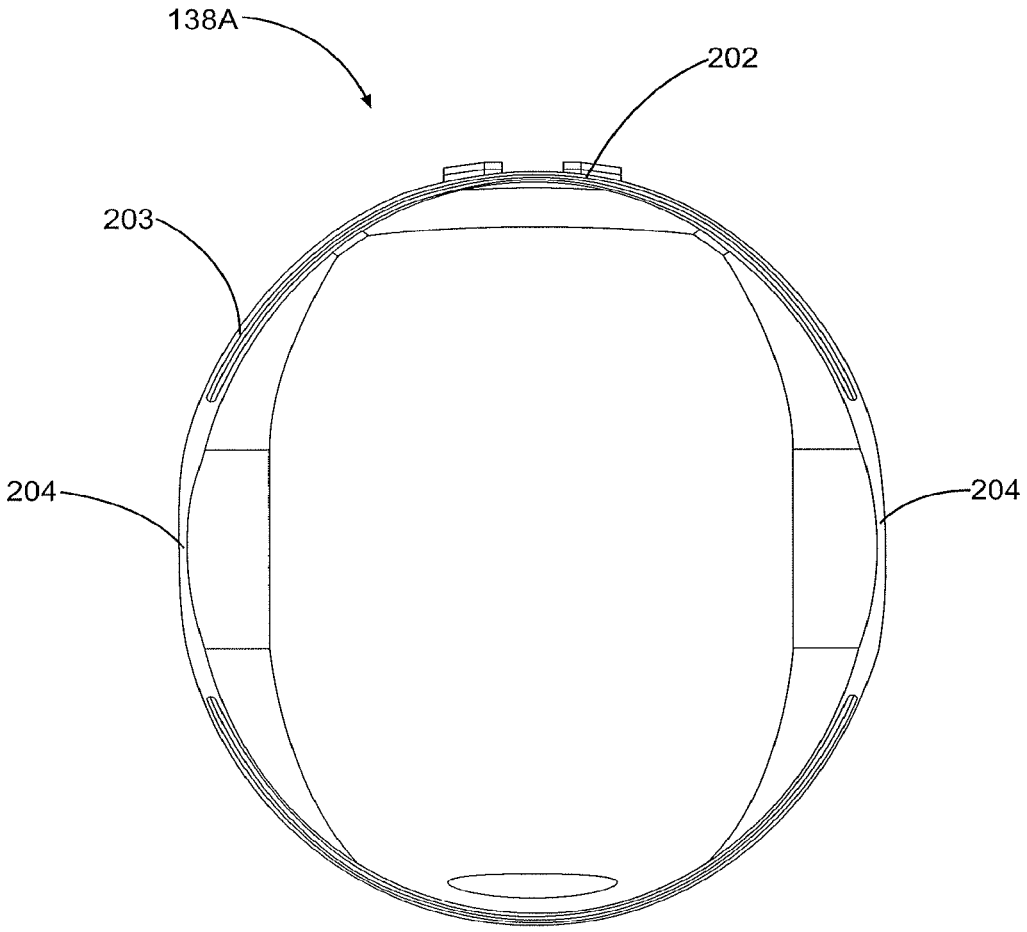
FIGS. 2A and 2B show a flapper that may be used in a SCSSV in accordance with an illustrative embodiment of the present disclosure.

FIG. 2A depicts a flapper 138A in accordance with an illustrative embodiment of the present disclosure. The flapper 138A includes a seal groove 202 that extends partially along a circumference of the flapper 138A and provides a space for a seal insert 203. In certain implementations, the seal insert 203 may be a bonded secondary seal material. A thin high stress area 204 may rest on a seat (not shown). In certain implementations, the seal insert may be made of Polyether Ether Ketone ("PEEK") or any other suitable materials. The seal groove 202 may be used to contain the seal insert 203. In accordance with some embodiments of the present disclosure, the seal insert may only be added to the thicker portions of the flapper 138A. Specifically, in certain implementations, the thinner portions of the flapper 138A and/or areas of the flapper 138A which are wide and/or low stressed may not include a seal insert.

Figure 2B:
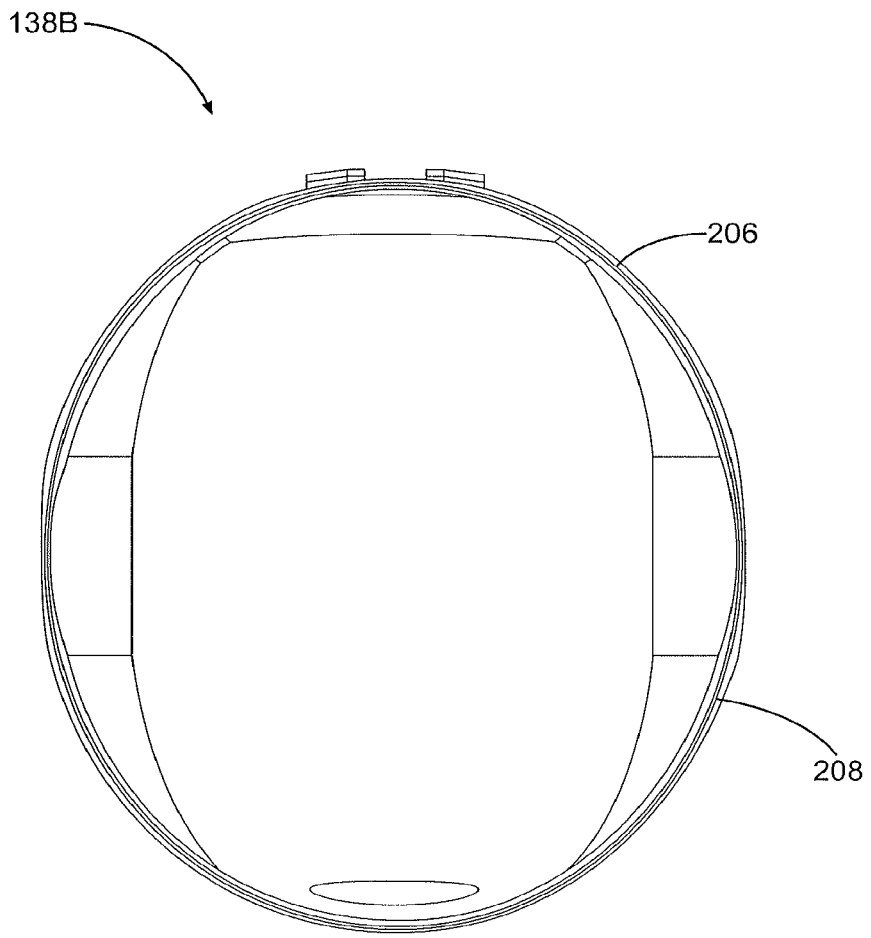

FIG. 2B depicts a flapper 138B in accordance with another illustrative embodiment of the present disclosure. In this embodiment, a seal groove 206 extends along substantially the whole outer circumference of the flapper 138B. As described in conjunction with FIG. 2A, the seal groove 206 may house a seal insert 208. The seal insert 208 may be made of any suitable materials such as a non-elastomer seal (e.g., PEEK). As shown in FIGS. 2A and 2B, in accordance with certain implementations, the seal groove 206 and the seal insert 208 placed therein may not be circular. As with the embodiment of FIG. 2A, the seal groove 206 and the seal insert 208 may be provided in the thicker portions of the flapper 138B.

Accordingly, the flapper 138 provides a seal that enhances debris tolerance and seals off low pressure gas. As would be appreciated by those of ordinary skill in the art, the flappers shown in FIGS. 2A and 2B are depicted for illustrative purposes. However, the present disclosure is not limited to any particular flapper shape. Accordingly, the flapper used may be of any suitable shape without departing from the scope of the present disclosure.

Returning now to FIG. 1, the disclosed hydraulic control system is designed to be fail-safe so that if any of the seals 108, 110, 112 fail, the flapper 138 will still close. The term "fail" as used herein with respect to the seals refers to a state where a seal has been degraded beyond a threshold value and is no longer effectively operating as a seal.

In accordance with an implementation of the present disclosure, under normal operating conditions, when the pressure (P1) from the single control line 106 drops below a certain threshold value, the pressure from the closure spring 136 overcomes the pressure applied by the rod piston 102 to the flow tube 134 and the flapper 138 is closed by the closure spring 136. If the seal 110 fails, the pressure on the first side of the middle portion 102B of the rod piston 102 (i.e., P1) will be the same as the pressure on the second side of the middle portion 102B of the rod piston 102 (i.e., P2) and the pressure applied by the pressure balanced piston is overcome by the compressed closure spring 136, thereby closing the flapper 138.

Similarly, if the seal 108 fails, high tubing pressure enters the second piston chamber 122, the second piston chamber branch 118 and the single control line 106. The high tubing pressure is then directed to the first compartment of the storage chamber 124 through the first storage chamber branch 120. Accordingly, the high tubing pressure in the first compartment of the storage chamber 124 will exceed the pressure (P2) in the second compartment of the storage chamber 124. As a result, the rupture disk 130 of the storage chamber 124 breaks. Once the rupture disk 130 is broken, P1 and P2 will both be at the high tubing pressure. Because P1 and P2 are equal, the pressure applied by the pressure balanced piston is overcome by the compressed closure spring 136, thereby closing the flapper 138.

Finally, if the seal 112 fails, the high tubing pressure enters the third piston chamber 126 and through the second storage chamber branch 128 into the second compartment of the storage chamber 124. As the pressure (P2) is raised to the high tubing pressure, it exceeds the pressure (P1) of the single control line 106. Once the pressure (P2) exceeds the pressure (P1) by a preset amount, the rupture disk 130 breaks and the pressures (P1) and (P2) will become the same. At this point, the pressure applied by the pressure balanced piston is overcome by the compressed closure spring 136, thereby closing the flapper 138.

In certain implementations, the SCSSV 100 may further include a port (not shown) which may be used to pressure test the metal-to-metal and/or elastomericaly sealed third piston chamber 126. Specifically, a user may use the port to measure the pressure in the third piston chamber 126 to ensure that it is at a desired pressure such as, for example, at vacuum. Accordingly, a rod piston actuator (not shown) with ends that seal on the same diameter may be used to balance the hydraulic piston with the tubing pressure. The forces created by the hydrostatic pressure applied through a single control line are significantly reduced by balancing the rod piston 102 hydraulic actuators with the tubing pressure. As a result, the minimum pressure required to hold the flapper 138 can be significantly reduced.

Accordingly, a deep set SCSSV is disclosed which can be operated with a single hydraulic control line. The changes in pressure of the three piston chambers 116, 122, 126 move the rod piston 102 between a first position and a second position. The movement of the rod piston 102 moves the flow tube 134 which in turn opens and closes the flapper 138. The disclosed SCSSV may be pressure balanced with the tubing pressure. As a result, the SCSSV may be operated with a low pressure hydraulic system.

As would be appreciated by those of ordinary skill in the art, the methods and systems disclosed herein may be applicable to more than just SCSSVs. Accordingly any reference to a "flow tube" is made for illustrative purposes only and is intended to generically refer to a part of a tool that is actuated by a piston assembly of a control system.

According to certain implementations of the present disclosure a method of operating a downhole valve may be practiced. Accordingly, a rod piston may be placed within a housing forming a first piston chamber, a second piston chamber and a third piston chamber. A high tubing pressure may then be applied to the first piston chamber through a high tubing pressure branch. A surface pressure may be applied to the second piston chamber through a single control line which couples the second piston chamber to a first compartment of a storage chamber. The third piston chamber and a second compartment of the storage chamber may be fluidically coupled to each other and a flapper may be coupled to the rod piston. Movement of the rod piston may be operable to open and close the flapper.

The present invention is therefore well-adapted to carry out the objects and attain the ends mentioned, as well as those that are inherent therein. While the invention has been depicted, described and is defined by references to examples of the invention, such a reference does not imply a limitation on the invention, and no such limitation is to be inferred. The invention is capable of considerable modification, alteration and equivalents in form and function, as will occur to those ordinarily skilled in the art having the benefit of this disclosure. The depicted and described examples are not exhaustive of the invention. Consequently, the invention is intended to be limited only by the spirit and scope of the appended claims, giving full cognizance to equivalents in all respects.

What is claimed is:

1. A hydraulic control system for controlling operation of a downhole valve comprising:

a rod piston disposed within a housing, wherein the rod piston and the housing form a first piston chamber, a second piston chamber and a third piston chamber, wherein a first piston chamber volume of the first piston chamber and a third piston chamber volume vary inversely as the rod piston is moved from one position to another in the housing;

a high tubing pressure branch, wherein the high tubing pressure branch delivers pressure to the first piston chamber, wherein the first piston chamber is between a first seal on a first distal end of the rod piston and a wall of the housing;

a single control line directed into the second piston chamber and a first storage chamber branch, wherein the single control line delivers a surface pressure to the second piston chamber, wherein the second piston chamber is between the first seal and a second seal on a first side of a middle portion of the rod piston, wherein the first storage chamber branch fluidically couples a first compartment of a storage chamber and the second piston chamber to maintain the first compartment and the second piston chamber at a first pressure;

a second storage chamber branch, wherein the second storage chamber branch fluidically couples a second compartment of the storage chamber and the third piston chamber, wherein a second pressure of the second compartment of the storage chamber is directed to the third piston chamber through the second storage chamber branch, wherein a compressible fluid maintains the second compartment of the storage chamber and the third piston chamber at a same pressure, and wherein the first compartment and the second compartment comprise a compressible fluid or a compressible gas; and a flow tube coupled to the rod piston and a flapper, wherein the flow tube moves between a first position and a second position in response to movement of the rod piston, and wherein movement of the flow tube between the first position and the second position is operable to at least one of open the flapper and close the flapper.

2. The hydraulic control system of claim 1, further comprising a closure spring, wherein the closure spring is biased to close the flapper.

3. The hydraulic control system of claim 1, wherein the rod piston comprises a third seal at a second distal end thereof.

4. The hydraulic control system of claim 1, wherein the rod piston comprises a middle portion having a first sealing diameter and a first distal end and a second distal end both having a second sealing diameter.

5. The hydraulic control system of claim 1, wherein the first compartment of the storage chamber and the second compartment of the storage chamber are separated by a rupture disk.

6. The hydraulic control system of claim 1, wherein the flapper comprises a seal groove and a seal insert.

7. The hydraulic control system of claim 6, wherein the flapper comprises a thicker portion and a thinner portion and wherein the seal groove and the seal insert are disposed in the thicker portion of the flapper.

8. A method of operating a downhole valve comprising:

disposing a rod piston within a housing comprising a first piston chamber, a second piston chamber and a third piston chamber, wherein a first piston chamber volume of the first piston chamber and a third piston chamber volume vary inversely as the rod piston is moved from one position to another in the housing, wherein the first piston chamber is between a first seal on a first distal end of the rod piston and a wall of the housing, and wherein second piston chamber is between the first seal and a second seal on a first side of a middle portion of the rod piston;

applying a high tubing pressure to the first piston chamber through a high tubing pressure branch;

applying a surface pressure to the second piston chamber through a single control line directed into the second piston chamber and a first storage chamber branch, wherein the single control line couples the second piston chamber to a first compartment of a storage chamber to maintain the first compartment and the second piston chamber at a first pressure;

fluidically coupling the third piston chamber and a second compartment of the storage chamber, wherein a compressible fluid maintains the second compartment of the storage chamber and the third piston chamber at a same pressure, wherein the second compartment of the storage chamber is at a second pressure, and , wherein the first compartment and the second compartment comprise a compressible fluid or a compressible gas; and coupling a flapper to the rod piston, wherein movement of the rod piston is operable to at least one of open and close the flapper.

9. The method of claim 8, wherein a flow tube couples the flapper to the rod piston and wherein the movement of the rod piston moves the flow tube.

10. The method of claim 8, further comprising providing a closure spring, wherein the closure spring is biased to move the flapper to a closed position.

11. The method of claim 8, further comprising sealing the rod piston within the housing, wherein the rod piston comprises a third seal at a second distal end thereof.

12. The method of claim 8, wherein the rod piston comprises a middle portion having a first sealing diameter and a first distal end and a second distal end both having a second sealing diameter.

13. The method of claim 8, further comprising separating the first compartment of the storage chamber and the second compartment of the storage chamber by a rupture disk.

14. The method of claim 8, further comprising providing the flapper with a seal groove and a seal insert.

15. The method of claim 14, wherein the flapper comprises a thicker portion and a thinner portion and wherein the seal groove and the seal insert are disposed in the thicker portion of the flapper.

16. A system for controlling operation of a downhole valve comprising:

a rod piston forming a first piston chamber, a second piston chamber and a third piston chamber within a housing, wherein a first piston chamber volume of the first piston chamber and a third piston chamber volume vary inversely as the rod piston is moved from one position to another in the housing, wherein the first piston chamber is fluidically coupled to a high tubing pressure, wherein the first piston chamber is between a first seal on a first distal end of the rod piston and a wall of the housing wherein the second piston chamber is fluidically coupled to:

a surface control line directed into the second piston chamber and a first storage chamber branch to maintain the first compartment and the second piston chamber at a first pressure; and a first compartment of a storage chamber, wherein the second piston chamber is between the first seal and a second seal on a first side of a middle portion of the rod piston, and wherein the third piston chamber is fluidically coupled to a second compartment of the storage chamber, wherein a compressible fluid maintains the second compartment of the storage chamber and the third piston chamber at a same pressure, wherein the second compartment of the storage chamber is at a second pressure, and wherein the first compartment and the second compartment comprise a compressible fluid or a compressible gas; and a flow tube, wherein the flow tube couples the rod piston to a flapper, and wherein the rod piston is moved between a first position and a second position in response to a change in a pressure in at least one of the first piston chamber, the second piston chamber and the third piston chamber; and wherein movement of the rod piston between the first position and the second position at least one of opens and closes the flapper.

17. The system of claim 16, further comprising a closure spring, wherein the closure spring is biased to move the flapper to a closed position.

18. The system of claim 16, wherein the rod piston comprises d a third seal at a second distal end thereof.

19. The system of claim 16, wherein the rod piston comprises a middle portion having a first sealing diameter and a first distal end and a second distal end both having a second sealing diameter.

20. The system of claim 16, wherein the first compartment of the storage chamber and the second compartment of the storage chamber are separated by a rupture disk.

* * * * *